US009399826B2

(12) United States Patent
Heo et al.

(10) Patent No.: US 9,399,826 B2
(45) Date of Patent: Jul. 26, 2016

(54) THIN FILM DEPOSITION APPARATUS AND THIN FILM DEPOSITION METHOD USING ELECTRIC FIELD

(71) Applicants: SAMSUNG ELECTRONICS CO., LTD., Suwon-si (KR); The Regents of the University of California, Oakland, CA (US)

(72) Inventors: Jin S. Heo, Hwaseong-si (KR); Hwi-yeol Park, Ansan-si (KR); Kyung-hoon Cho, Yongin-si (KR); Kyoung-hwan Choi, Seoul (KR); Se-jung Kim, La Jolla, CA (US); Michael J. Heller, La Jolla, CA (US); Young-jun Song, La Jolla, CA (US)

(73) Assignees: SAMSUNG ELECTRONICS CO., LTD., Suwon-si (KR); The Regents of The University of California, Oakland, CA (US)

( * ) Notice: Subject to any disclaimer, the term of this patent is extended or adjusted under 35 U.S.C. 154(b) by 0 days.

(21) Appl. No.: 14/278,638

(22) Filed: May 15, 2014

(65) Prior Publication Data

US 2015/0329984 A1 Nov. 19, 2015

(51) Int. Cl.
*C25D 13/00* (2006.01)

(52) U.S. Cl.
CPC ..... *C25D 13/00* (2013.01)

(58) Field of Classification Search
CPC ..... C25D 13/00; C25D 13/02; C25D 13/12; C25D 1/00; C25D 1/12; C25D 1/006; H01J 9/025; B82Y 15/00
See application file for complete search history.

(56) References Cited

U.S. PATENT DOCUMENTS

| | | | | |
|---|---|---|---|---|
| 6,652,808 | B1 | 11/2003 | Heller et al. | |
| 6,780,584 | B1 * | 8/2004 | Edman et al. | 435/6.19 |
| 2006/0249388 | A1 | 11/2006 | Chang et al. | |
| 2007/0056628 | A1 | 3/2007 | Park et al. | |
| 2011/0108422 | A1 * | 5/2011 | Heller et al. | 204/547 |
| 2011/0250467 | A1 | 10/2011 | Rose et al. | |
| 2012/0098032 | A1 | 4/2012 | Guo et al. | |
| 2012/0190040 | A1 * | 7/2012 | Talebpour et al. | 435/7.1 |
| 2012/0211365 | A1 | 8/2012 | Joung et al. | |
| 2013/0004761 | A1 | 1/2013 | Worsley et al. | |

FOREIGN PATENT DOCUMENTS

| | | | |
|---|---|---|---|
| JP | 11-329217 | A | 11/1999 |
| JP | 4130655 | B2 | 5/2008 |
| JP | 4894101 | B2 | 3/2012 |
| JP | 5178060 | B2 | 1/2013 |

* cited by examiner

*Primary Examiner* — Xiuyu Tai
(74) *Attorney, Agent, or Firm* — Sughrue Mion, PLLC

(57) ABSTRACT

A thin film deposition apparatus and a thin film deposition method using an electric field are provided. The thin film deposition apparatus includes: a first substrate; a plurality of electrodes in a 2D arrangement on the first substrate; and a solution provided on the plurality of electrodes and in which charged nanoparticles are distributed, wherein the charged nanoparticles are selectively deposited on at least a part of the plurality of electrodes by independently applying a voltage to each of the plurality of electrodes.

9 Claims, 8 Drawing Sheets

THIN FILM DEPOSITION APPARATUS AND THIN FILM DEPOSITION METHOD USING ELECTRIC FIELD

BACKGROUND

1. Field

Apparatuses and methods consistent with exemplary embodiments relate to a thin film deposition apparatus and a thin film deposition method, and more particularly, to a thin film deposition apparatus and a thin film deposition method for selectively forming a multilayer thin film of a layer-by-layer structure on electrodes by using an electric field.

2. Description of the Related Art

A typical electrophoretic deposition method deposits a thin film by applying a direct current voltage to a solution containing positive (+) or negative (−) charged nanoparticles which are distributed and moving the charged nanoparticles to electrodes of opposite polarities. However, the electrophoretic deposition method is limited in its ability to stack various different materials in a 2D or 3D shape, and has the problem of increased processing costs and processing time when a mask is used. A photolithography method is typically used in semiconductor processing to deposit a thin film. However, the photolithography method uses a mask and includes diverse operations such as etching, and thus it also has the problem of increased processing costs and processing time.

SUMMARY

One or more exemplary embodiments may provide a thin film deposition apparatus and a thin film deposition method for selectively forming a multilayer thin film of a layer-by-layer structure on electrodes by using an electric field.

Additional exemplary aspects will be set forth in part in the description which follows and, in part, will be apparent from the description, or may be learned by practice of the presented embodiments.

According to an exemplary embodiment, a thin film deposition apparatus includes: a first substrate; a plurality of electrodes disposed on the first substrate in 2D arrangement; and a solution provided on the plurality of electrodes within which charged nanoparticles are distributed, wherein the charged nanoparticles are selectively deposited on at least a part of the plurality of electrodes by independently applying a voltage to each of the plurality of electrodes.

The thin film deposition apparatus may form a multilayer thin film comprising a multilayered structure comprising at least a first nanoparticle layer of a first material and a second nanoparticle layer of a second material, different from the first material.

The nanoparticles may include metal, ceramics, or polymer. The voltage applied to each of the plurality of electrodes may be in the range of about 1.2 V to about 7 V.

A membrane layer may be further provided on the plurality of electrodes to cover the electrodes. The membrane layer may include at least one material selected from a group consisting of nefion, nitrocellulose, agarose gel and hydrogel. First and second auxiliary electrodes may be provided on opposite sides of the solution.

A second substrate may be provided on the solution. The second substrate may include a conductive material. At least one of a first material layer including a flexible material and a second material layer may be provided on the plurality of electrodes. The second material layer may be a material which is transformable into a transparent material by annealing in a solvent.

The first substrate may include a porous material as a gas removal substrate, and the plurality of electrodes may have porosity. A direct current or alternating current voltage in the range of about 3 V to 3000 V may be applied to each of the plurality of electrodes.

According to another exemplary embodiment, a thin film deposition method is provided. The method uses a thin film deposition apparatus including: a first substrate; a plurality of electrodes disposed on the first substrate in a 2D arrangement; and a solution provided on the plurality of electrodes and in which charged nanoparticles are distributed. The method includes: independently controlling a voltage applied to each of the plurality of electrodes, thereby selectively depositing the charged nanoparticles on at least one of the plurality of electrodes.

The method may further include: discharging gases generated in the solution due to an electrolysis around the plurality of electrodes.

BRIEF DESCRIPTION OF THE DRAWINGS

These and/or other exemplary aspects and advantages will become apparent and more readily appreciated from the following description of exemplary embodiments, taken in conjunction with the accompanying drawings in which.

DETAILED DESCRIPTION

Figure 1:
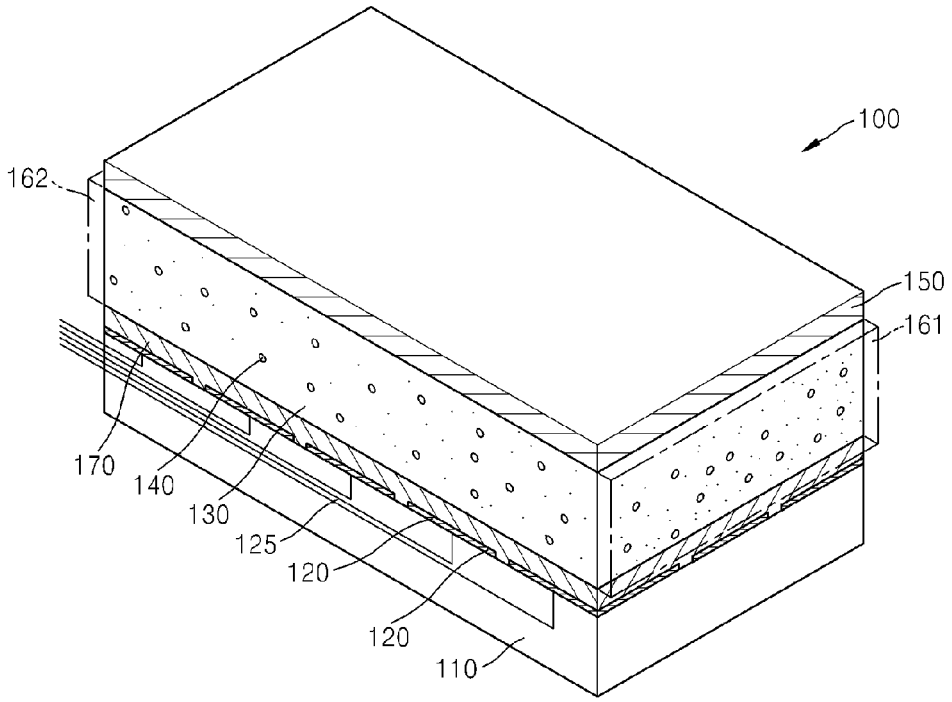
FIG. 1 is a schematic perspective view of a thin film deposition apparatus according to an exemplary embodiment.

Reference will now be made in detail to exemplary embodiments which are illustrated in the accompanying drawings, wherein like reference numerals refer to like elements throughout. In the drawings, widths and thicknesses of layers or regions may be exaggerated for clarity. In this regard, the exemplary embodiments may have different forms and should not be construed as being limited to the descriptions set forth herein. Accordingly, the embodiments are merely described below, by referring to the figures, for purposes of clarity of explanation. When a material layer is referred to as being on a substrate or another layer, the material layer may directly contact the substrate or the other layer, or intervening layers may also be present. A material forming each layer in the embodiments below is exemplary, and thus other materials may be used. As used herein, the term "and/or" includes any and all combinations of one or more of the associated listed items. Expressions such as "at least one of," when preceding a list of elements, modify the entire list of elements and do not modify the individual elements of the list.

FIG. 1 is a schematic perspective view of a thin film deposition apparatus 100 according to an exemplary embodiment.

Referring to FIG. 1, the thin film deposition apparatus 100 includes a plurality of electrodes 120 provided on a first substrate 110, and a solution 130 provided on the electrodes 120 and containing charged nanoparticles 140 which are distributed within the solution. The first substrate 110 is used to support the electrodes 120, and may be, for example, a glass substrate, or a substrate formed of any of various materials, as would be understood by one of skill in the art. The electrodes 120 are provided on the first substrate 110 in predetermined shapes.

Figure 2:
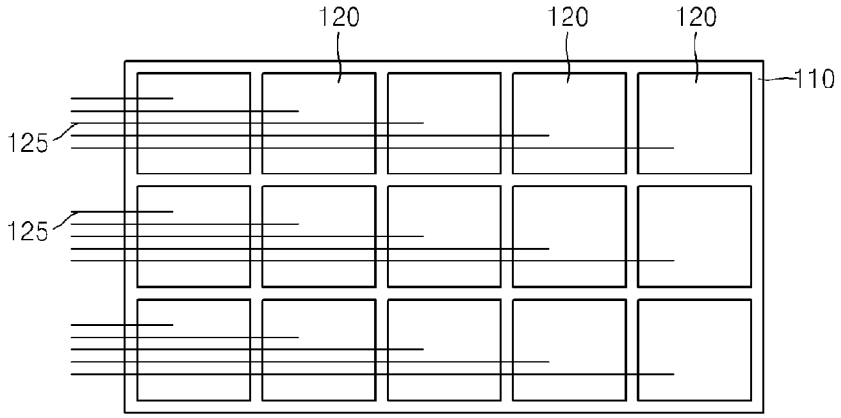
FIG. 2 is a plan view of electrodes of FIG. 1.

FIG. 2 is a plan view of the electrodes 120 of FIG. 1. Referring to FIG. 2, the electrodes 120 are arranged on the first substrate 110 in a 2D arrangement. Although the electrodes 120 are arranged in a 5×3 matrix in FIG. 2 as an example, the electrodes 120 may be arranged in any of various arrangements. In this regard, the electrodes 120 are provided to be independently driven. That is, the electrodes 120 are provided to control voltages thereof. To this end, each of the electrodes 120 is connected to a wiring 125 which applies a voltage to the electrode 120 to which it is connected. Accordingly, desired voltages may be selectively applied to the electrodes 120. The electrodes 120 may be formed of metal, such as Pt, Ni, or Cu, but are not limited thereto. Although a range of voltages applied to the electrodes 120 may be, for example, in the range of about 1.2 V to about 7 V during a thin film deposition process, since this is merely an example, other voltages may be applied to the electrodes 120.

A membrane layer 170 may be provided on the electrodes 120, between the electrodes 120 and the solution 130, to cover the electrodes 120. The membrane layer 170 is used to easily separate a thin film structure including multilayer thin films (140 of FIG. 7), formed on the membrane layer 170, from the electrodes 120 through, for example, a lift-off process. The membrane layer 170 may include, for example, at least one material selected from the group consisting of nefion, nitrocellulose, agarose gel and hydrogel, but is not limited thereto.

The solution 130, in which the charged nanoparticles 140 are distributed, is provided on the membrane layer 170. In this regard, the nanoparticles 140 may be charged to have a positive (+) or a negative (−) charge. A surface charge amount of the nanoparticles 140 may be controlled by adjusting the zeta-potential according to a pH change in the solution 130. The nanoparticles 140 may include, for example, metal, ceramics, or polymer, and other various materials. The solution 130 may include, for example, deionized (DI) water or N-Methyl-2-pyrrolidine, but is not limited thereto. First and second auxiliary electrodes 161 and 162 may be provided on both sides of the solution 130. The first and second auxiliary electrodes 161 and 162 function to easily move the charged nanoparticles 140, which are distributed in the solution 130, from one side to another side in the solution 130. That is, if predetermined voltages are applied to the first and second auxiliary electrodes 161 and 162, the charged nanoparticles 140 may move from the first auxiliary electrode 161 to the second auxiliary electrode 162 or from the second auxiliary electrode 162 to the first auxiliary electrode 161.

A second substrate 150 may be provided on the solution 130. In this regard, the second substrate 150 and the first substrate 110 may function to accommodate the solution 130 therebetween. The second substrate 150 may be a substrate formed of any of various materials. When the second substrate 150 includes a conductive material, the second substrate 150 may function as an electrode that may easily deposit the charged nanoparticles 140 on the electrodes 120. That is, if a predetermined voltage is applied to the second substrate 150, the charged nanoparticles 140 which are distributed in the solution 130 may be deposited by more quickly moving to the electrodes 120.

In the thin film deposition apparatus 100 having the above-described structure, if an electric field is formed in the solution 130 by applying a predetermined voltage to each of the electrodes 120 that are arranged on the first substrate 110 in the 2D shape, the charged nanoparticles 140 which are distributed in the solution 130 are deposited only on the electrodes 120 to which specific voltages are applied. As a result, a thin film including a nanoparticle layer may be formed on the membrane layer 170 in a predetermined pattern. In this case, if predetermined voltages are applied to the first and second auxiliary electrodes 161 and 162, the charged nanoparticles 140 may be deposited on the electrodes 120 by moving the charged nanoparticles from one side to another side within the solution 130. As described above, if the electric field is formed in the solution 130 by controlling the voltages applied to the electrodes 120, which are arranged in the 2D shape, the thin film may be formed by selectively depositing the charged nanoparticles 140 on the desired electrodes 120. If the nanoparticles 140 including two or more materials are selectively deposited on the electrodes 120, multilayer thin films, having a layer-by-layer structure may be formed in a desired shape, and accordingly, a 2D- or 3D-shaped thin film structure may be easily manufactured. The thin film structure may be manufactured in any of various scales, such as a micro scale, a wafer scale, or a macro scale, in a desired shape.

FIGS. 3 through 6 are cross-sectional views for explaining a method of forming a thin film by using the thin film deposition apparatus 100 of FIG. 1. A case in which first through fourth nanoparticles 141, 142, 143, and 144, which are distributed in the solution 130, are charged to negative (−) charge will be described below.

Figure 3:
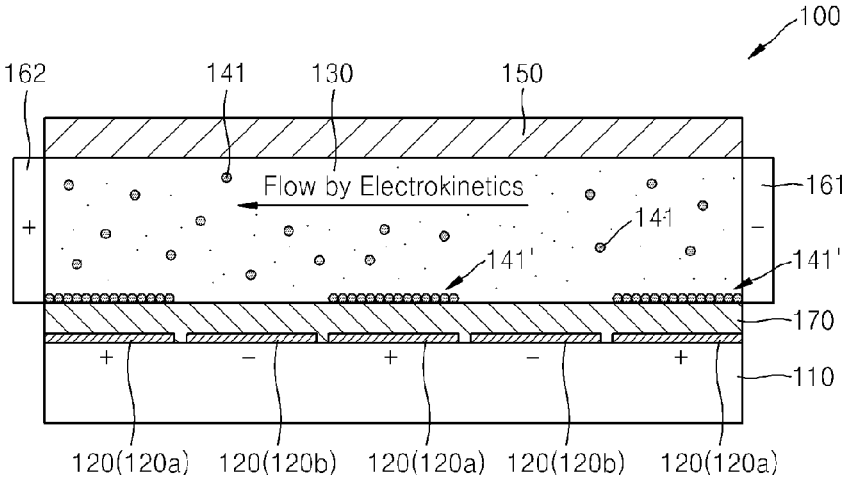
FIGS. 3 through 6 are cross-sectional views for explaining a method of forming a thin film by using the thin film deposition apparatus of FIG. 1.

Referring to FIG. 3, the solution 130, in which the first nanoparticles 141 charged to a negative (−) polarity are distributed, is provided between the first substrate 110 and the second substrate 150. A predetermined voltage is applied to each of the electrodes 120 that are arranged on the first substrate 110 in a 2D arrangement. In this regard, voltages of from about 1.2 V to about 7 V may be applied to the electrodes 120, but the voltages are not limited thereto. Electrodes **120*a* of FIG. 3 have positive (+) polarities, and electrodes 120*b* have negative (−) polarities. Accordingly, an electric field is formed in the solution 130 and is used to selectively deposit the first nanoparticles 141 on the electrodes 120. That is, the first nanoparticles 141 charged to negative (−) polarities are deposited by moving to the electrodes 120*a* having positive (+) polarities, as a result, a first nanoparticle layer 141' is formed on the membrane layer 170 in a predetermined pattern. When the first and second auxiliary electrodes 161 and 162 have respectively negative (−) and positive (+) polarities according to applications of voltages, the first nanoparticles 141 charged to negative (−) polarities may move from the first auxiliary electrode 161 to the second auxiliary electrode 162 in the solution 130 and may be selectively deposited on the electrodes 120*a* having positive (+) polarities. When the second substrate 150 has a negative (−) polarity, the first nanoparticles 141 which are charged to negative (−) polarities and distributed in the solution 130 may be deposited by more quickly moving to the electrodes 120*a*** having positive (+) polarities.

Figure 4:
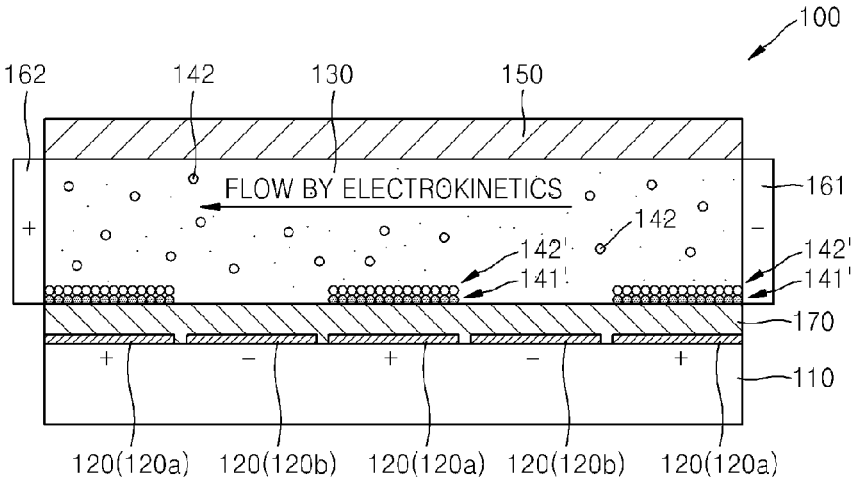

Referring to FIG. 4, the solution 130 in which the second nanoparticles 142 charged to negative (−) are distributed is provided between the first substrate 110 and the second substrate 150. In this regard, the second nanoparticles 142 may be formed of a different material from that of the first nanoparticles 141. As described above, a predetermined voltage is applied to each of the electrodes 120 that are arranged on the first substrate 110 in a 2D arrangement. Accordingly, an electric field is formed in the solution 130 and is used to selectively deposit the second nanoparticles 142 on the electrodes 120. That is, the second nanoparticles 142 charged to negative (−) polarities are deposited on the first nanoparticle layer 141' by moving to the electrodes 120*a* having positive (+) polarities, and a second nanoparticle layer 142' is formed on the first nanoparticle layer 141'. As a result, sequentially stacked the first and second nanoparticle layers 141' and 142' are formed on the membrane layer 170 in a predetermined pattern. As described above, when the first and second auxiliary electrodes 161 and 162 have respectively negative (−) and positive (+) polarities, the second nanoparticles 142 charged to negative (−) polarities may move from the first auxiliary electrode 161 to the second auxiliary electrode 162 in the solution 130 and may be selectively deposited on the electrodes 120*a* having positive (+) polarities. When the second substrate 150 has a negative (−) polarity, the second nanoparticles 142 which are charged to negative (−) polarities and distributed in the solution 130 may be deposited by more quickly moving to the electrodes 120*a* having positive (+) polarities.

Figure 5:
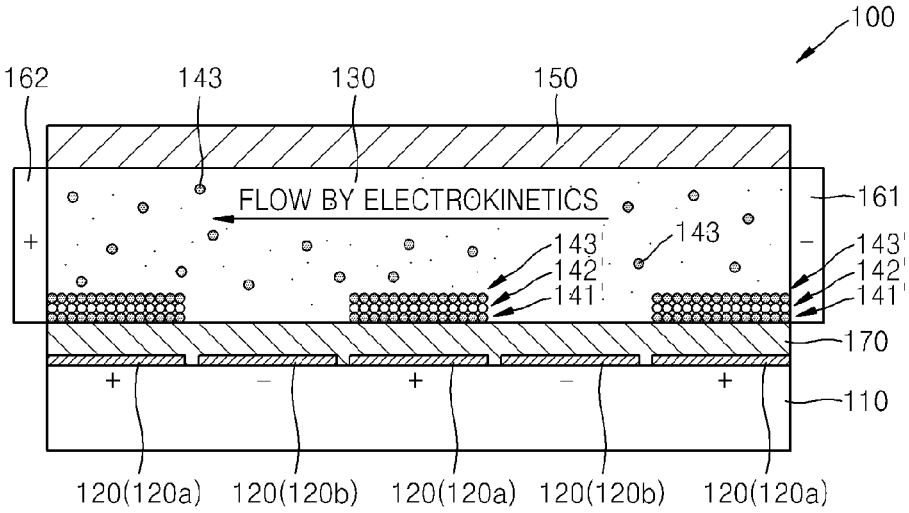

Referring to FIG. 5, the solution 130 in which the third nanoparticles 143 charged to negative (−) are distributed is provided between the first substrate 110 and the second substrate 150. In this regard, the third nanoparticles 143 may be formed of a different material from that of the second nanoparticles 142. As described above, a predetermined voltage is applied to each of the electrodes 120 that are arranged on the first substrate 110 in a 2D arrangement. Accordingly, the third nanoparticles 143 charged to negative (−) polarities are deposited on second nanoparticles 142' by moving to the electrodes 120*a* having positive (+) polarities, and a third nanoparticle layer 143' is formed on the second nanoparticle layer 142'. As a result, sequentially stacked the first through third nanoparticle layers 141', 142', and 143' are formed on the membrane layer 170 in a predetermined pattern. As described above, when the first and second auxiliary electrodes 161 and 162 have respectively negative (−) and positive (+) polarities, the third nanoparticles 143 charged to negative (−) polarities may move from the first auxiliary electrode 161 to the second auxiliary electrode 162 in the solution 130 and may be selectively deposited on the electrodes 120*a* having positive (+) polarities. When the second substrate 150 has a negative (−) polarity, the third nanoparticles 143 which are charged to negative (−) polarities and distributed in the solution 130 may be deposited by more quickly moving to the electrodes 120*a* having positive (+) polarities.

Figure 6:
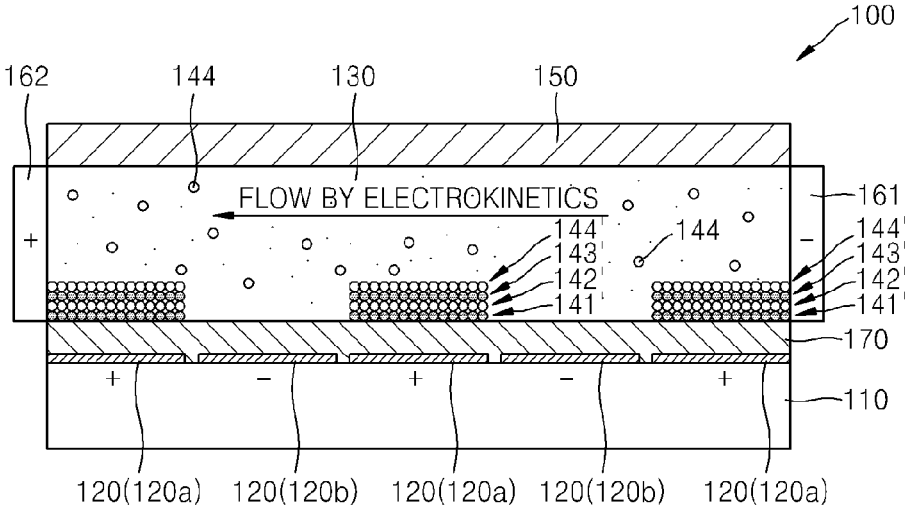

Referring to FIG. 6, the solution 130 in which the fourth nanoparticles 144 charged to negative (−) polarities are distributed is provided between the first substrate 110 and the second substrate 150. In this regard, the fourth nanoparticles 144 may be formed of a different material from that of the third nanoparticles 143. As described above, a predetermined voltage is applied to each of the electrodes 120 that are arranged on the first substrate 110 in a 2D arrangement. Accordingly, the fourth nanoparticles 144 charged to negative (−) polarities are deposited on third nanoparticles 143' by moving to the electrodes 120*a* having positive (+) polarities, and a fourth nanoparticle layer 144' is formed on the third nanoparticle layer 143'. As a result, sequentially stacked the first through fourth nanoparticle layers 141', 142', 143', and 144' are formed on the membrane layer 170 in a predetermined pattern. As described above, when the first and second auxiliary electrodes 161 and 162 have respectively negative (−) and positive (+) polarities, the fourth nanoparticles 144 charged to negative (−) polarities may move from the first auxiliary electrode 161 to the second auxiliary electrode 162 in the solution 130 and may be selectively deposited on the electrodes 120*a* having positive (+) polarities. When the second substrate 150 has a negative (−) polarity, the fourth nanoparticles 144 which are charged to negative (−) polarities and distributed in the solution 130 may be deposited by more quickly moving to the electrodes 120*a* having positive (+) polarities.

As described above, the first through fourth nanoparticle layers 141', 142', 143', and 144' are sequentially stacked on the membrane layer 170, thereby forming multilayer thin films 140', having a layer-by-layer structure, in a predetermined pattern, and completing a thin film structure including the multilayer thin films 140' in a desired pattern.

Figure 7:
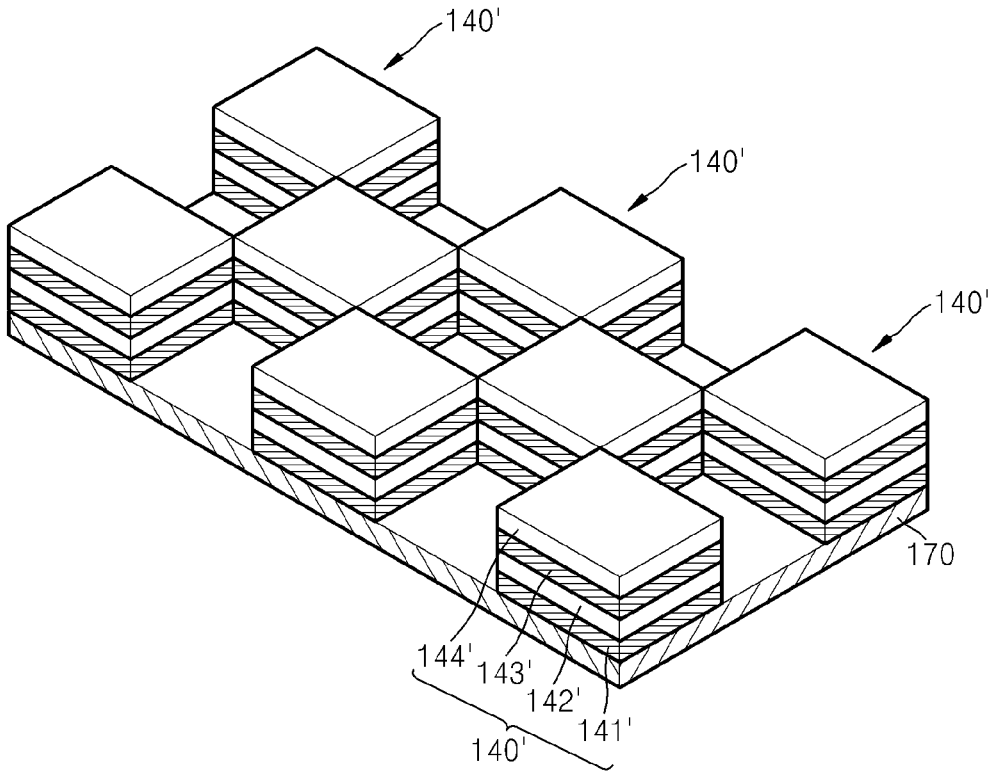
FIG. 7 is a perspective view of a thin film structure formed by using the method of forming a thin film of FIG. 6 that are separated from electrodes.

FIG. 7 is a perspective view of a thin film structure formed by using the method of forming a thin film of FIG. 6 that is separated from the electrodes 120 through, for example, a lift-off process. Referring to FIG. 7, the multilayer thin films 140', having the layer-by-layer structure formed by sequentially depositing the first through fourth nanoparticle layers 141', 142', 143', and 144', are formed on the membrane layer 170 in a predetermined pattern. The multilayer thin films 140' include the first through fourth nanoparticle layers 141', 142', 143', and 144' but are not limited thereto. The number of nanoparticle layers forming the multilayer thin films 140' may be modified in various ways.

Figure 8:
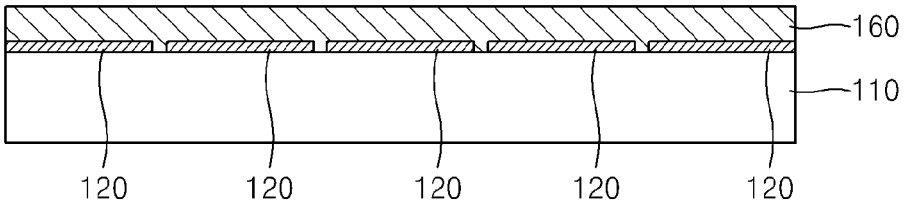
FIGS. 8 through 10 are cross-sectional views for explaining a process of changing a membrane layer on which a thin film structure is formed to a transparent material layer through annealing in a solvent.
Figure 9:
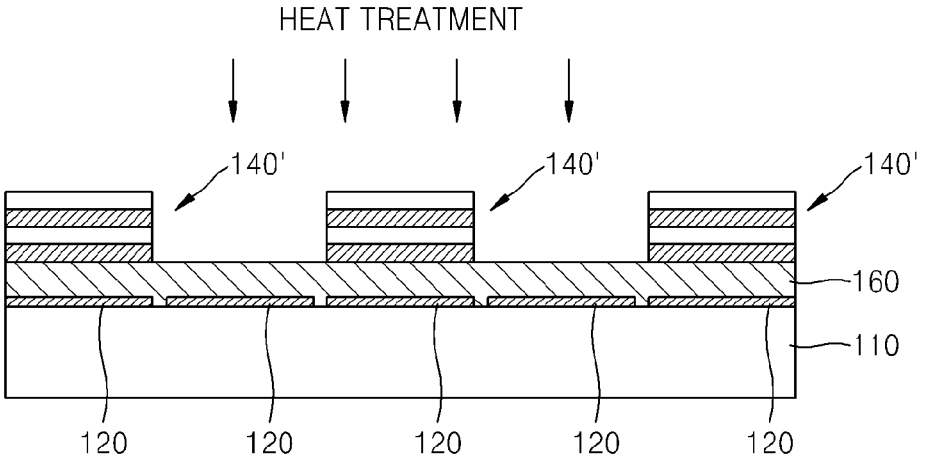
Figure 10:
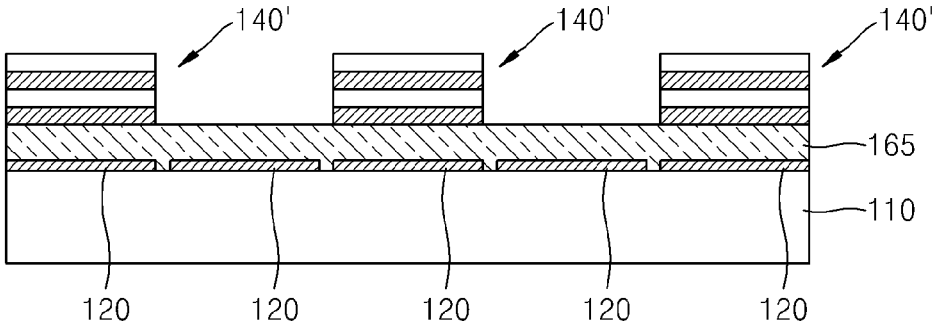

The thin film structure may be implemented on a substrate formed of a transparent material. FIGS. 8 through 10 are cross-sectional views for explaining a process of changing a membrane layer 160 on which a thin film structure is formed to a transparent material layer 154 through annealing in a solvent.

Referring to FIG. 8, the electrodes 120 are arranged on the first substrate 110 in a 2D arrangement and are independently driven. The membrane layer 160 is formed on the electrodes 120 to cover the electrodes 120. The membrane layer 160 is used to easily separate the thin film structure formed on the membrane layer 160 from the first substrate 110. In this regard, the membrane layer 160 may be formed of a material that may be changed to a transparent material through annealing. For example, the membrane layer 160 may be formed of nitrocellulose.

Referring to FIG. 9, the multilayer thin films 140' of a layer-by-layer structure are formed on the membrane layer 160 in a predetermined pattern through the process described with reference to FIGS. 3 through 6. Thereafter, annealing is performed on the structure, as shown in FIG. 9. In more detail, when the membrane layer 160 is formed of nitrocellulose, annealing using a solvent may be performed on the membrane layer 160 at about 85° C. for 30 minutes. If annealing is performed on the membrane layer 160 formed of nitrocellulose, the membrane layer 160 may be changed to the transparent material layer 165 as shown in FIG. 10. Then, the transparent material layer 165 may be separated from the electrodes 120 through the lift-off process. As described above, the membrane layer 160 is formed of a material that may be changed to the transparent material by annealing in the present embodiment, thereby manufacturing the thin film structure on a transparent substrate. Accordingly, a device formed of the transparent material may be implemented.

Figure 11:
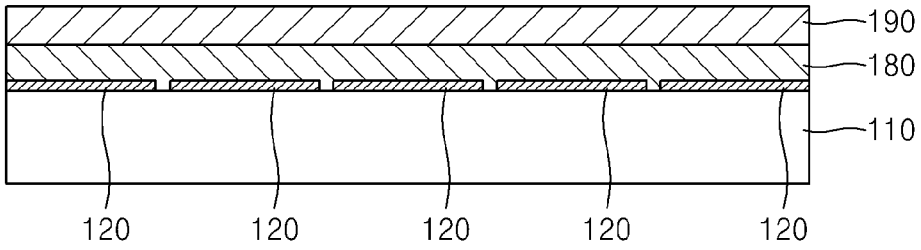
FIG. 11 is a cross-sectional view of a first material layer formed of a flexible material and a second material layer formed of a transparent material changed by annealing that are stacked on electrodes.

The thin film structure may be implemented on a substrate formed of a flexible material and/or a substrate formed of the transparent material. FIG. 11 is a cross-sectional view of a first material layer 180 formed of a flexible material and a second material layer 190 formed of a transparent material changed by annealing that are stacked on the electrodes 120.

Referring to FIG. 11, the electrodes 120 are arranged on the first substrate 110 in a 2D arrangement and are independently driven. The first material layer 180 is formed on the electrodes 120 to cover the electrodes 120. In this regard, the first material layer 180 may be formed of, for example, the flexible material such as nylon or plastic. The second material layer 190 may be formed on the first material layer 180. The second material layer 190 may be formed of the transparent material changed by annealing, for example, nitrocellulose.

In the above-described structure, if a thin film structure is formed on the second material layer 190 by using the method of FIGS. 3 through 6 above, the thin film structure may be manufactured on a flexible substrate. Accordingly, a device formed of the flexible material may be implemented. The second material layer 190 may be formed of the transparent material changed by annealing, thereby manufacturing the thin film structure on the flexible substrate.

Figure 12:
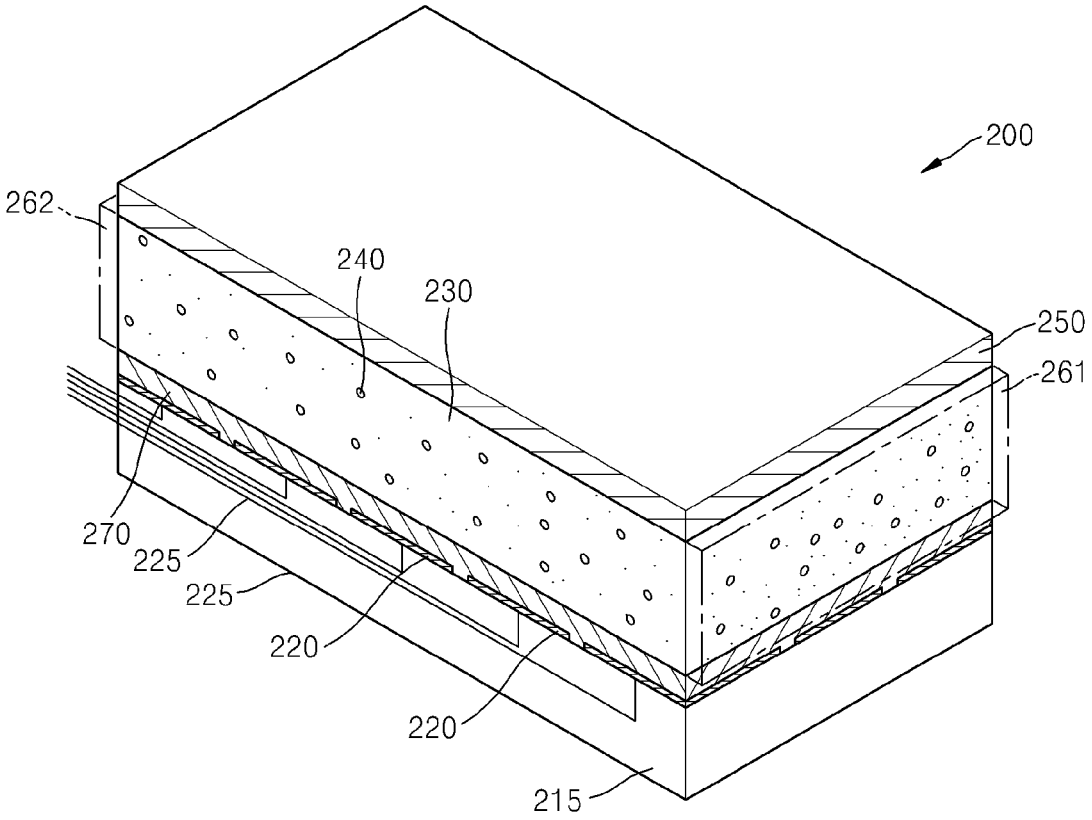
FIG. 12 is a schematic perspective view of a thin film deposition apparatus according to another exemplary embodiment.

FIG. 12 is a schematic perspective view of a thin film deposition apparatus 200 according to another exemplary embodiment. Differences between the present embodiment and the previous embodiment will now be described.

Referring to FIG. 12, the thin film deposition apparatus 200 includes a first substrate 210, a plurality of electrodes 220 provided on the first substrate 210, and a solution 230 provided on the electrodes 220 and containing charged nanoparticles 240 which are distributed in the solution 230. In the present embodiment, the first substrate 210 may include a porous material as a gas removal substrate. In more detail, if a strong electric field is applied to the solution 230 during a process of depositing a thin film, a water decomposition occurs due to an electrochemical reaction, and thus $H_2$ gas and $O_2$ gas are generated. The $H_2$ gas and $O_2$ gas are necessarily removed since they are obstacles to deposition. To remove the $H_2$ gas and $O_2$ gas, the first substrate 210 includes the porous material used to discharge gas in the present embodiment.

The electrodes 220 are arranged on the first substrate 210 in a 2D arrangement, and, as described above, are provided to be independently driven. To this end, each of the electrodes 220 is connected to a wiring 225 for applying a voltage to the electrode. The electrodes 220 may be formed of metal such as Pt, Ni, or Cu but are not limited thereto. The electrodes 220 may include the porous material used to discharge gas like the first substrate 210. Direct current or alternating current voltages, for example, in the range of about 3 V to 300 V may be applied to the electrodes 220.

A membrane layer 270 may be further provided on the electrodes 220 to cover the electrodes 220. The membrane layer 270 is used to easily separate a thin film structure, including multilayer thin films formed on the membrane layer 270, from the electrodes 220 through a lift-off process. The membrane layer 270 may include, for example, at least one material selected from the group consisting of nefion, nitrocellulose, agarose gel and hydrogel, but is not limited thereto. The membrane layer 270 may include the porous material like the first substrate 210 and the electrodes 220 as described above.

The solution 230 containing the charged nanoparticles 240 which are distributed therein is provided on the membrane layer 270. In this regard, the nanoparticles 240 may be charged to positive (+) or negative (−) polarities. A surface charge amount of the nanoparticles 240 may be controlled by adjusting zeta-potential according to a pH change in the solution 230. The nanoparticles 240 may include, for example, metal, ceramics, or polymer, and other various materials. The solution 230 may include, for example, DI water or N-Methyl-2-pyrrolidine but is not limited thereto. First and second auxiliary electrodes 261 and 262 may be provided on both sides of the solution 230. The first and second auxiliary electrodes 261 and 262 function to easily move the charged nanoparticles 240, which are distributed in the solution 230, from one side to another side within the solution 230. A second substrate 250 may be provided on the solution 230. In this regard, the second substrate 250 and the first substrate 210 may function to accommodate the solution 230 therebetween. The second substrate 250 may be a substrate formed of any of various materials. When the second substrate 250 includes a conductive material, the second substrate 250 may function as an electrode that may easily deposit the charged nanoparticles 240 on the electrodes 220.

Figure 13:
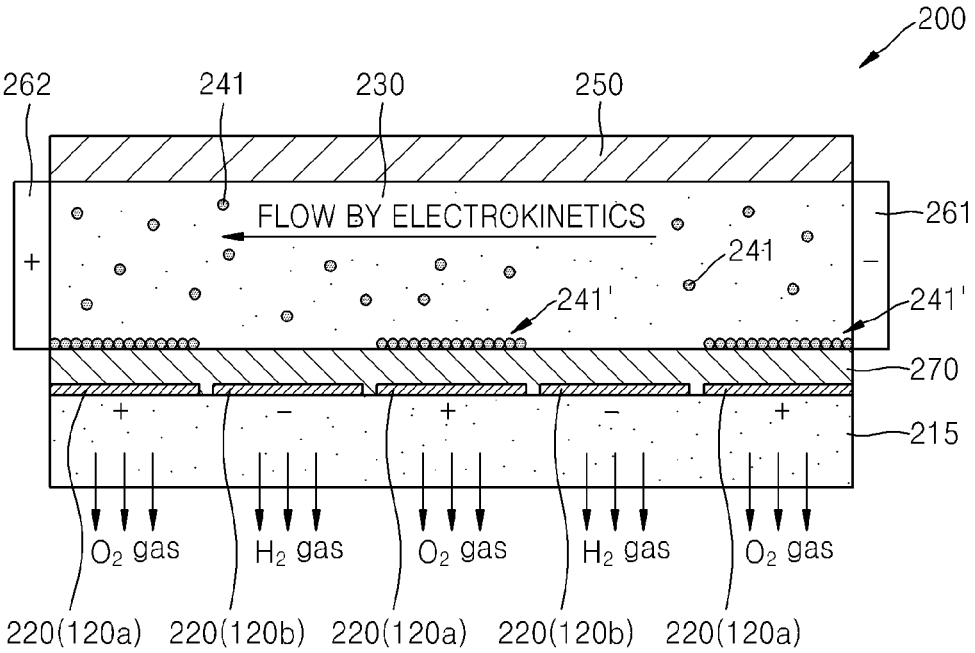
FIG. 13 is a cross-sectional view of gases that are generated during a process of forming thin films of the thin film deposition apparatus of FIG. 12 and are discharged to the outside.

FIG. 13 is a cross-sectional view of gases which are generated during a process of forming thin films in the thin film deposition apparatus 200 of FIG. 12 and which are discharged to the outside. According to this example, electrodes 220*a* of FIG. 13 have positive (+) polarities, and electrodes 220*b* have negative (−) polarities.

Referring to FIG. 13, the process of forming thin films of the thin film deposition apparatus 200 was described in detail with reference to FIGS. 3 through 6 above, and thus a description thereof is omitted. If a strong electric field is applied to the solution 230, a water decomposition occurs due to an electrochemical reaction, and thus $H_2$ gas and $O_2$ gas are generated. The $H_2$ gas and $O_2$ gas need to be removed so as to easily perform a deposition process since they are obstacles to deposition. Thus, the first substrate 210, the electrodes 220, and the membrane layer 270 are formed of porous materials in the present embodiment so that the $H_2$ gas and $O_2$ gas that are generated during the water decomposition are discharged to the outside through the membrane layer 270, the electrodes 220, and the first substrate 210. In more detail, the $H_2$ gas is discharged to the outside through electrodes 220*b* having negative (−) polarities and the first substrate 210, and the $O_2$ gas is discharged to the outside through electrodes 220*a* having positive (+) polarities and the first substrate 210. In this regard, direct current or alternating current voltages, for example, in the range of about 3 V to 300 V, may be applied to the electrodes 220*a* and 220*b*.

As described above, gases generated during a thin film deposition process are discharged to the outside through the membrane layer 270, the electrodes 220, and the first substrate 210 that are formed of porous materials, and thus thins films may be easily formed on the electrodes 220. If the nanoparticles 240 including two or more materials are selectively formed on the electrodes 220, multilayer thin films of a layer-by-layer structure may be formed in a desired shape, and thus a thin film structure in a 2D or 3D shape may be easily manufactured.

As described above, according to the one or more of the above embodiments of the thin film deposition apparatus and the thin film deposition apparatus, an electric field is formed in a solution by controlling a voltage applied to each of electrodes arranged in a 2D arrangement, and thus charged nanoparticles are selectively deposited on desired electrodes, thereby forming thin films. Thus, if nanoparticles including two or more materials are selectively deposited on electrodes, multilayer thin films of a layer-by-layer structure may be formed in a desired shape, and accordingly, a thin film structure in a 2D or 3D arrangement may be easily manufactured at low cost. The thin film structure may be manufactured in various scales, such as a micro scale, a wafer scale, or a macro scale, in a desired shape. When a gas is generated in a solution according to an application of an electric field, electrodes are formed of porous materials, thereby efficiently discharging the gas to the outside.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims.

What is claimed is:

1. A thin film deposition apparatus comprising:

a first substrate;

a plurality of electrodes disposed on the first substrate in a two-dimensional arrangement;

a membrane layer disposed on the plurality of electrodes, the membrane layer comprising a first layer, disposed to cover the electrodes, and a second layer disposed on the first layer, wherein the first layer comprises a flexible material and the second layer is transformable into a transparent material by annealing the second layer in a solvent; and a solution disposed on the plurality of electrodes, the solution comprising a plurality of charged nanoparticles distributed therewithin, wherein the charged nanoparticles are selectively deposited on at least one of the plurality of electrodes by independently controlling voltages applied to each of the plurality of electrodes.

2. The thin film deposition apparatus of claim 1, wherein the thin film deposition apparatus forms a multilayer thin film comprising a multilayered structure comprising at least a first nanoparticle layer of a first material, and a second nanoparticle layer of a second material, different from the first material.

3. The thin film deposition apparatus of claim 1, wherein the nanoparticles comprise metal, ceramics, or polymer.

4. The thin film deposition apparatus of claim 1, wherein the voltages applied to each of the plurality of electrodes are within a range of about 1.2 V to about 7 V.

5. The thin film deposition apparatus of claim 1, further comprising a first auxiliary electrode disposed at a first side of the solution, and a second auxiliary electrode disposed at a second side of the solution, opposite the first side.

6. The thin film deposition apparatus of claim 1, further comprising a second substrate disposed on the solution.

7. The thin film deposition apparatus of claim 6, wherein the second substrate comprises a conductive material.

8. The thin film deposition apparatus of claim 1, wherein the first substrate comprises a porous material, and the plurality of electrodes are porous, such that gas within the solution is transmitted through the plurality of electrodes and the first substrate.

9. The thin film deposition apparatus of claim 8, wherein a direct current voltage in a range of about 3 V to 3000 V or an alternating current voltage in the range of about 3 V to 3000 V is applied to each of the plurality of electrodes.

* * * * *